US008043399B1

(12) United States Patent
Hse et al.

(10) Patent No.: US 8,043,399 B1
(45) Date of Patent: Oct. 25, 2011

(54) PROCESS FOR RAPID MICROWAVE-ENHANCED DETOXIFICATION OF CCA-TREATED WOOD

(75) Inventors: Chung-Yun Hse, Alexandria, LA (US); Todd Finley Shupe, Baton Rouge, LA (US); Bin Yu, Baton Rouge, LA (US); Hui Pan, Calhoun, LA (US)

(73) Assignee: Board of Supervisors of Louisiana State University and Agricultural and Mechanical College LSU Inc, Baton Rouge, LA (US)

( * ) Notice: Subject to any disclaimer, the term of this patent is extended or adjusted under 35 U.S.C. 154(b) by 0 days.

(21) Appl. No.: 12/836,687

(22) Filed: Jul. 15, 2010

(51) Int. Cl.
*C22B 3/20* (2006.01)

(52) U.S. Cl. ..... 75/10.13; 75/739; 75/740; 75/743; 423/27; 423/34; 423/53; 423/55; 423/87; 588/315; 588/318

(58) Field of Classification Search ..... 75/10.13, 75/743, 739, 740; 423/27, 53, 87, 34, 55
See application file for complete search history.

(56) References Cited

U.S. PATENT DOCUMENTS 4,038,086 A 7/1977 Clarke et al.
4,942,064 A * 7/1990 Brayman et al. ..... 427/297
7,160,526 B2 * 1/2007 Lianzhen et al. ..... 423/34
2003/0108462 A1 6/2003 Oskoui
2004/0225173 A1 11/2004 Lianzhen et al.
2006/0292309 A1 * 12/2006 Kakitani et al. ..... 427/440
2007/0036699 A1 2/2007 Oskoui
2007/0056655 A1 3/2007 Vinden
2008/0131717 A1 6/2008 Obanda et al.

* cited by examiner

*Primary Examiner* — George Wyszomierski
*Assistant Examiner* — Tima M McGuthry Banks
(74) *Attorney, Agent, or Firm* — James C. Carver; The Carver Law Firm

(57) ABSTRACT

A method for detoxifying spent CCA (copper, chromium, arsenic) treated wood, from which CCA is efficiently removed from the wood, allowing both the CCA and the wood to be reused has been developed. The method comprises the steps of (1) microwave-enhanced acid extraction of CCA, (2) separation of the acid-containing CCA solution from the wood, (3) separation/precipitation of CCA from the acid extract, (4) recovery and regeneration of CCA-bearing precipitant for reuse in the wood preservation industry, (5) recycling recovered acid solution, (6) microwave-assisted liquefaction of the extracted wood, and (7) use of detoxified liquefied wood to form polymeric materials such as polyurethanes and phenolic resin adhesives. The recovered CCA may be used to treat wood. The recovered acids may be used to extract CCA from CCA-treated wood, and the liquefied wood may be used as phenolic or polyurethane resins.

45 Claims, 1 Drawing Sheet

Flowchart of the CCA separation process by microwave-assisted acid extraction

Flowchart of the CCA separation process by microwave-assisted acid extraction

PROCESS FOR RAPID MICROWAVE-ENHANCED DETOXIFICATION OF CCA-TREATED WOOD

FIELD OF THE INVENTION

This application pertains to a novel method for recycling wood products treated with chromate copper arsenate (CCA). The novel method effectively and efficiently removes chromium, copper, and arsenic from treated wood in an environmentally safe manner, such that the recovered metals may be used, and the detoxified wood may be used.

BACKGROUND OF THE INVENTION

Preservatives are well known to significantly prolong the service life of wood and thereby extend forest resources and enhance their sustainability. For many years, chromated copper arsenate (CCA) has been widely used as a wood preservative. In this use, it appears that copper functions as a fungicide, arsenic functions as an insecticide and co-fungicide, and hexavalent chromium helps bind arsenic and copper to the wood. During the process of CCA fixation, it is believed that the hexavalent chromium is reduced to trivalent chromium, and copper and arsenic are precipitated within the wood as low soluble complex compounds.

Demand for CCA-treated wood products has increased since the early 1970's for residential applications such as decks and fences, and for industrial products such as utility poles, timbers, and marine pilings. During 2001, approximately 150 million pounds of CCA preservatives were used in the production of preservative-treated wood. About 28.8 million pounds of CCA (dry oxide concentrate basis) were consumed by the US wood treating industry in 2004. However, in 2002, the US and Canadian wood preservation industry agreed to voluntarily withdraw the use of CCA-treated wood for residential and consumer products by the end of 2003. CCA-treated wood continues to be used in industrial applications (e.g., utility poles, timbers, and marine pilings). The amount of spent CCA-treated wood is expected to increase from 3-4 million $m^3$/yr. currently to about 12 million $m^3$/yr. during the next 15 years. Since the expected average service life of CCA-treated wood is between 20-40 years, spent CCA-treated wood is expected to continue to be disposed for decades.

The environmental and human health impacts of CCA-treated wood have received attention because of the toxicity of copper, chromium, and arsenic. CCA-treated wood has been disposed primarily in construction and demolition (C&D) debris landfills or in municipal solid waste (MSW) landfills. Thus, there is increased concern about contamination of soil and groundwater with copper, chromium, and arsenic from disposal sites.

Alternative waste management strategies and technologies, other than landfills, for spent CCA treated wood have been developed.

Reuse Without Chemical Treatment

Because a CCA-treating solution does not penetrate the heart wood of large dimension treated products, untreated portions of treated wood products can be obtained by re-sawing or shaving the treated exterior and then re-using the heart wood. The option of re-sawing treated wood appears to be feasible for industrial products, but of limited potential for residential products. Further, mechanical abrasion of the treated exterior may cause fine wood particles contaminated with metals to become airborne, which may raise environmental concerns.

Spent CCA-treated wood may be reused in wood based composites, wood-cement composite, or other composite materials. The CCA-metals, however, tend to interfere with adhesives, and thus adversely affect the physical and mechanical properties of such composites.

Solvent Extraction of CCA

Hot sulfuric acid, hot nitric acid, aqueous ammonia solutions, acetic acid, and formic acid may be used to extract CCA. Such extraction techniques appear to convert the metals into water soluble salts. Solvent extraction, however, typically is not complete for all three CCA metals. In addition, strong acids also tend to cause excessive decomposition of the wood components.

Lianzhen et al. (U.S. Pat. No. 7,160,526) discloses a method of recovering CCA by liquefying the treated wood at high temperature with a strong acid, followed by precipitation of the metals or complexation of the metals. This method requires a temperature between about 100° C. to 250° C., which may cause vaporization of arsenic. This method also may require several hours to obtain reasonable extraction.

U.S. Pat. Application No, 2006/0292309 discloses a method to detoxify treated wood by using an aqueous solution of an alkali metal mono- or di-carboxylate as an extractant.

Another extraction method uses chelating agents, such as ethylenediaminetetraacetic acid (EDTA), nitrilotriacetic acid (NTA), oxalic acid, or citric acid to remove reactive metals.

U.S. Pat. Application No. 2007/0036699 discloses use of a lixivant, for example, a chelating agent, to extract Cu, Cr, and As from treated wood. There are several disadvantages for detoxifying spent CCA-treated wood products using chelating agents, including, large amounts of chemical solvent required, long extraction times typically required, and resulting extraction solutions that are difficult to handle.

Bioremediation

Bioremediation, comprising microbial metal removal from toxic wastes, has been used to extract (CCA from spent treated wood. Several varieties of brown-rot fungi have been used to remove metals from CCA-treated wood. It is believed that oxalic acid, which is thought to act as a leaching agent, is secreted from the fungi. Some metal-tolerant bacteria are effective in removing 93% Cu and 45% As, but are ineffective for removing Cr. Bioremediation also is limited by the time-consuming nature of the process and by the high cost of the nutrient culture medium.

While detoxification technology has focused primarily on removing CCA from the wood, few methods have included recycling of treated wood or recovering chromated copper arsenate for reuse.

There remains an unfilled need for a method for detoxifying CCA-treated wood that is economically effective, environmentally sound, provides for recycling spent treated wood, and allows reuse of recovered chromate copper arsenate.

We have developed a method for detoxifying CCA-treated wood that comprises microwave-enhanced acid extraction of CCA. This method allows removal of over 99% of all these metals, allows detoxified wood to be used as a base material for forming polymeric materials, and allows reuse of recovered chromated copper arsenate for treatment of untreated wood.

SUMMARY OF THE INVENTION

Figure 1:
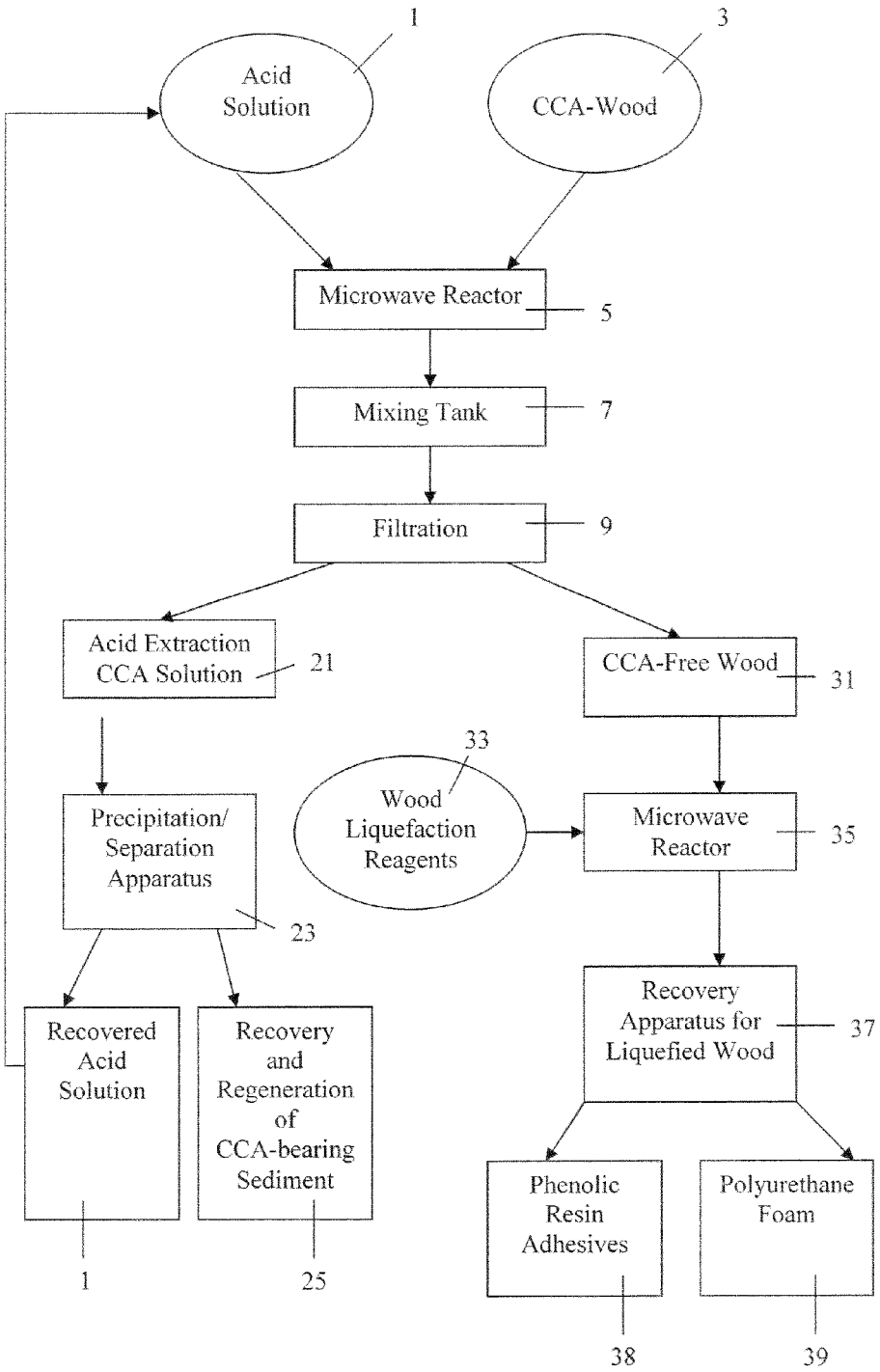
FIG. 1 depicts a schematic of the method.

We have developed a novel method for detoxifying and recycling spent CCA-treated wood. This method rapidly removed in excess of 99% of the copper, chromium, and arsenic from treated wood at relatively low temperatures. The method also allowed recovery of the CCA constituents for reuse, and allowed detoxified wood to be reused in the preparation of adhesives or plastics. As shown in FIG. 1, the method comprises seven steps: (1) microwave-enhanced acid extraction of CCA, (2) separation of the acid-containing CCA solution from the wood, (3) separation/precipitation of CCA from the acid extract, (4) recovery and regeneration of CCA-bearing precipitant for reuse in the wood preservation industry, (5) recycling recovered acid solution, (6) microwave-assisted liquefaction of the extracted wood, and (7) use of detoxified liquefied wood to form polymeric materials such as polyurethanes and phenolic resin adhesives. A mixture of two or more acids [1] and wood that had previously been treated with CCA [3] were added together and placed in a Microwave Reactor [5] with a Mixing Tank [7]. After the acid/wood mixture was subjected to microwave radiation, the mixture was then subjected to filtration [9]. Next, the filtrate, the acid extracted CCA solution [21], was separated from the solid CCA-free wood [31]. At this point, a precipitating agent was added to the acid extracted CCA solution in a Precipitation/Separation Apparatus [23], from which the original acid solution [1] was recovered for reuse in the CCA extraction process. Further, recovery and regeneration of CCA-bearing sediment [25] remains and may be used for treating untreated wood. Wood liquefaction reagents [33] were added to the CCA-free wood [31], and this mixture was placed in a Microwave Reactor [35], causing the wood to be liquefied. The liquefied wood was recovered in a Recovery Apparatus for Liquefied Wood [37], and the liquefied wood may be used in a number of ways, including as phenolic resin adhesives [38] or polyurethane foam [39].

CCA Reclaimation

The present invention differs from prior art because (a) the present invention teaches the use of microwave heating to enhance the extraction process, while minimizing heating time and temperature, and (b) the present invention teaches a method for complete removal and recovery of both CCA and detoxified wood. While not wishing to be bound by theory, it is believed that the use of microwave radiation causes extraction to occur at lower average temperatures and far more rapidly than seen with conventional heating techniques. Metal extraction with conventional heating may require a temperature that causes a metal, for example, arsenic, to be vaporized in part. Therefore, our invention minimizes the risk for the release of toxic substances, for example, arsene gas, during extraction.

This process is rapid and is economically effective. This method is suitable for various CCA-treated wood products with different metal concentrations, for example, from about 0.5% to about 35% CCA.

MODES FOR CARRYING OUT THE INVENTION

Spent CCA-treated wood, to which was added an acid solution, for example, acetic acid, oxalic acid, sulfuric acid, hydrochloric acid, phosphoric acid, or a combination of acids of sufficient volume to extract copper, chromium, and arsenic, was placed in a microwave reactor. The acid/wood mixture was subjected to sufficient microwave radiation to cause the treated wood to reach a temperature of between 70-190° C. The preferred extraction medium comprised two acids with the acid dissociation constants (pKa) of greater than 1.0 and, furthermore, at least one of the acids was selected from mineral acids, for example, as phosphoric acid, sulfuric acid, or nitric acid. It is believed that microwave radiation facilitated solvating metals by polarizing the high dielectric acid. The second acid is believed to have dissolved the metals. The acid containing the dissolved metal components was then separated from the wood by filtration. Since the wood structure of the extracted wood remained essentially intact, it was recovered for other uses.

Because the metals, in particular arsenic, may be volatilized at moderate temperatures, it is important that extraction be conducted at low temperatures. The method revealed herein required low temperatures and short reaction times, thereby diminishing the probability of vaporization of metals or metals compound.

Wood Reclaimation

Wood liquefaction reagents, such as phenol, polyethylene glycol, glycerin, ethylene carbonate, and acid catalysts were added to CCA-free wood, and this mixture then was placed in a microwave reactor. Sufficient radiation was applied to the mixture to raise the temperature to between 80-190° C. This step converted the CCA-free wood into a thick liquid having a molecular weight ranging from about several hundred to about several thousand.

The liquefied wood solution was concentrated and used as a bio-based raw material for the preparation of polymer materials, for example, polyurethanes or phenolic adhesives.

CCA also was regenerated for recycling. CCA separated from the acid extraction solution was in a form that could be used directly to treat wood for protection against decay.

In one embodiment, spent CCA-treated wood was used as received, without any prior crushing or grinding. However, in a preferred embodiment, the spent wood (the CCA-treated wood that is destined for disposal) was first crushed or ground into chips or powder. The size of the wood particles was not critical, but wood particles that passed through a number 20-mesh sieve were preferable.

Acid extraction of CCA-treated wood was performed in a microwave reactor. A solution comprising one or more acids was mixed with CCA-treated wood. The acid/wood mixture was then subjected to heating by microwave radiation. The preferred temperature was from about 80° C. to about 190° C., and most preferably from about 90° C. to 160° C. The acid/wood mixture was heated for a time sufficient to solvate or dissolve CCA into acid solution, typically about 3 to 180 min., and preferably from about 5 to 30 min. An aqueous solution of CCA and wood from which CCA was extracted remained after this process.

The extraction acids were selected from the group consisting of mineral acids, strong organic acids, Lewis acids, or mixtures thereof. Enhanced dissolution of the metal from CCA-treated wood occurred when at least one of the acids used had a high dielectric constant, for example, greater than 1.0, for example, phosphoric acid. A mixture of acids was preferred, and a mixture of acetic acid and phosphoric acid was most preferred. The concentration of acids used to solvate or dissolve CCA was typically in the range from 0.5% to 20% by weight, and most preferably from 0.1 to 5.0% by weight. The ratio of acid to wood ranged from about 1:1 to about 40:1, and preferably from about 5:1 to about 30:1.

While not wishing to be bound by this theory, it appears that during acid extraction in a microwave reactor, an acid, which has a high dielectric constant, surrounds the wood particles. In one embodiment, microwaves, generated in a magnetron, are pulsed. When solvent molecules with high dielectric constants absorb microwave energy, they become polarized. When the microwave field is removed, thermally induced disorder is restored. It appears that this process may cause localized superheating effects, as well as heating of the bulk solution. Thermal equilibrium of the system appears to establish within the system as heat is transferred from the bulk solution and from superheated pockets. Microwave heating also appears to have enhanced diffusivity of the solvent into the matrix, and thereby enhanced extraction of copper, chromium, and arsenic. Similarly, the solvated metals efficiently diffused out of the wood matrix under the influence of microwave radiation.

After extraction, the acid solution containing CCA was filtered. The filtrate was separated from spent wood, and then the filtrate was transferred to a precipitation/filtration apparatus. Precipitating or complex agents, for example, $Ca(OH)_2$ or phosphoric acid, were added to the filtrate, which caused Cu, Cr, and As to precipitate. Recovery of the Cr, Cu, and As from the solution was completed by centrifugation or filtration. The method extracted more than 99% each of Cu, Cr, and As from treated wood.

A CCA-complex was regenerated from the precipitant by adding concentrated inorganic acid, for example, sulfuric, nitric or phosphoric acid, to the precipitant. The recovered CCA-complex could be reused as a wood preservative.

Acid remaining after precipitation of CCA from the acid solution was reused without further purification in the metal extraction step of this method.

A liquefaction reagent, for example, phenol, polyethylene glycol, glycerin, ethylene carbonate, or a strong acid, was mixed with the extracted wood and this mixture was heated in a microwave reactor. The preferred temperature was from about 80° C. to 190° C., and most preferably from about 140° C. to 160° C., for a time sufficient to convert the wood into a thick liquid, typically about 3 to 180 min., and preferably about 10 to 30 min. The resultant material was a thick liquid with molecular weights ranging from several hundred to several thousand.

The liquefied wood solution was concentrated to a desirable concentration for use as bio-based raw materials for the preparation of polymer materials, such as polyurethanes and phenolic resins.

EXAMPLES

For all examples provided below, metals were extracted in a microwave system in which the temperature of the sample being irradiated was measured.

Example 1

Wood chips from treated wood were dried at about 150° C. and then milled into sawdust. The dried sawdust was screened through a 40-mesh sieve. A dilute acid solution of oxalic acid, acetic acid, or phosphoric acid was mixed with the dried sawdust in a ratio of 1 g sawdust to 20 ml of dilute acid. The concentrations of the acids ranged from about 0.25% to about 1.00% by weight. The acid/sawdust mixture was then transferred to a 100 ml vessel, which was then sealed and placed in a microwave chamber (Milestone, Sheton, Conn.). The acid/sawdust mixture was heated by microwave radiation for approximately 30 minutes at approximately 160° C. The resulting material was then filtered, and the filtrate was diluted with sufficient water to raise the filtrate volume to 100 ml. The concentrations of each acid and their extraction efficiencies are shown in Table 1 below.

TABLE 1

CCA recovery rate in single acid of different concentration at 160° C. for 30 min.

| Acid | Acid Conc. (wt %) | As (% removed) | Cr (% removed) | Cu (% removed) |
|---|---|---|---|---|
| Oxalic | 0.25 | 99.39 | 98.32 | 35.38 |
| Oxalic | 0.50 | 99.04 | 98.87 | 35.64 |
| Oxalic | 0.75 | 99.12 | 98.86 | 36.77 |
| Oxalic | 1.00 | 99.35 | 99.32 | 38.62 |
| Oxalic | 1.50 | 99.66 | 99.69 | 39.62 |

TABLE 1-continued

CCA recovery rate in single acid of different concentration at 160° C. for 30 min.

| Acid | Acid Conc. (wt %) | As (% removed) | Cr (% removed) | Cu (% removed) |
|---|---|---|---|---|
| Acetic | 0.25 | 49.81 | 8.24 | 46.61 |
| Acetic | 0.50 | 91.84 | 15.29 | 93.89 |
| Acetic | 0.75 | 90.19 | 14.08 | 93.40 |
| Acetic | 1.00 | 94.78 | 22.20 | 94.62 |
| Acetic | 1.50 | 97.97 | 51.53 | 97.49 |
| Phosphoric | 0.50 | 57.56 | 12.66 | 59.69 |
| Phosphoric | 0.75 | 58.13 | 15.00 | 72.11 |
| Phosphoric | 1.00 | 60.05 | 16.64 | 77.50 |
| Phosphoric | 1.50 | 65.12 | 19.32 | 78.59 |

Table 1 shows that oxalic acid and acetic acid effectively removed As. More than 99% of As and 98% of Cr were extracted using oxalic acid. More than 97% of As and Cu were extracted using acetic acid. However, phosphoric acid did not effectively remove As, Cr, or Cu. Table 1 shows that none of the acids tested, when used singly, were effective at extracting all three metals.

It appears that the concentration of oxalic acid, within the range of the experiment, had little effect on CCA extraction. Table 1 shows that more than 90% of As and 93% of Cu were extracted from sawdust in acetic acid above concentrations of 0.5%, but the amount of As and Cu removal decreased substantially (i.e., almost 50%) as acetic acid concentration decreased below 0.5% (0.25%). At a phosphoric acid concentration of 1.5%, maximum removal of Cu and As were 78.59% and 65.12%, respectively; the removal of Cr was less than 20%.

Example 2

Wood chips from treated wood were prepared as described in paragraph [0036]. A mixture of acetic acid and oxalic acid was added to the dried sawdust in a ratio of 1 g of sawdust to 20 ml of the acid mixture. The concentrations of each acid and the ratio of acids are described below in Table 2. The acid/wood mixture was transferred to a 100 ml vessel, which was then sealed and placed in a microwave chamber (Milestone, Sheton. CT). The acid/wood mixture was heated by microwave radiation for approximately 30 minutes at approximately 160° C. The resulting material was filtered and the filtrate was diluted with sufficient water to raise the filtrate volume to 100 ml. Extraction efficiency is shown in Table 2 below.

TABLE 2

CCA recovery rate in different concentrations of mixed oxalic and acetic acid at 160° C. for 30 min.

| Acetic Acid Conc. (wt %) | Oxalic Acid Conc. (wt %) | As (% removed) | Cr (% removed) | Cu (% removed) |
|---|---|---|---|---|
| 1.5 | 1.0 | 99.65 | 99.88 | 34.57 |
| 1.0 | 1.0 | 99.67 | 99.89 | 32.93 |
| 0.5 | 1.0 | 99.59 | 99.65 | 31.50 |
| 1.5 | 0.5 | 99.56 | 99.43 | 31.47 |
| 1.0 | 0.5 | 99.21 | 99.37 | 30.60 |
| 0.5 | 0.5 | 98.78 | 99.38 | 30.11 |

Table 2 shows that nearly 100% of As and Cr can be removed by any combination of acetic or oxalic acid at concentrations between 0.5 to 1.5%. However, none of the combinations yielded favorable results for Cu removal, and the highest amount of Cu removed was only 34.57% at an acetic acid and oxalic acid concentration of 1.5 and 1%, respectively.

Example 3

Wood chips from treated wood were prepared as described in paragraph [0036]. A mixture of phosphoric acid and either oxalic acid or acetic acid was added to the dried sawdust in a ratio of 1 g sawdust to 20 ml of the acid mixture. The concentrations of phosphoric acid ranged from about 0.5% to about 3.5% by weight. The concentration of oxalic acid or acetic acid was about 1% by weight. The acid/wood mixture was transferred to a 100 ml vessel, which was then sealed and placed in a microwave chamber (Milestone, Sheton, Conn.). The acid/wood mixture was heated by microwave radiation for approximately 30 minutes at approximately 160° C. The resulting material was filtered, and the filtrate was diluted with sufficient water to raise the filtrate volume to 100 ml. The extraction efficiencies are shown in Table 3 below.

TABLE 3

CCA recovery rate in different concentration of phosphoric acid when mixed with 1% oxalic or 1% acetic acid at 160° C. for 30 min.

| Phosphoric Acid Conc. (wt %) | Oxalic/Acetic Acid Conc. (wt %) | As (% removed) | Cr (% removed) | Cu (% removed) |
|---|---|---|---|---|
| 0.5% | Oxalic acid 1% | 99.52 | 97.12 | 33.82 |
| 1.25% | Oxalic acid 1% | 99.12 | 97.39 | 36.49 |
| 2.0% | Oxalic acid 1% | 98.90 | 97.67 | 41.30 |
| 3.5% | Oxalic acid 1% | 99.58 | 98.77 | 52.14 |
| 0.5% | Acetic acid 1% | 94.05 | 23.52 | 95.38 |
| 1.25% | Acetic acid 1% | 96.66 | 50.03 | 97.38 |
| 2.0% | Acetic acid 1% | 99.01 | 72.18 | 97.46 |
| 3.5% | Acetic acid 1% | 99.52 | 98.10 | 98.60 |

Table 3 shows the CCA recovery rate in different concentration of phosphoric acid when mixed with 1% oxalic or 1% acetic acid at 160° C. for 30 min. Low concentrations of phosphoric acid (0.5%) and oxalic acid (1%) was successful in removing 99.52 and 97.12% of As and Cr, respectively. However, the removal of Cu was poor regardless of the concentration of oxalic acid, for example, 33.82-52.14%.

When 1% acetic acid was combined with 3.5% phosphoric acid, when enhanced by microwave radiation, greater than 98% of each metal was extracted. This combination resulted in the removal of 99.52, 98.10, and 98.60% of As, Cr, and Cu, respectively, as shown in Table 3.

Example 4

Wood chips from treated wood were prepared as described in paragraph [0036]. A mixture of phosphoric acid and acetic acid was added to the dried sawdust in a ratio of 1 sawdust to 20 ml of the acid mixture. The concentrations of phosphoric acid ranged from about 0.5% to about 3.5% by weight. The concentrations of acetic acid ranged from about 0.5% to about 2% by weight. The acid/wood mixture was transferred to a 100 ml vessel, which was then sealed and placed in a microwave chamber (Milestone, Sheton, Conn.). The acid/wood mixture was heated by microwave radiation for approximately 30 minutes to approximately 160° C. The resulting material was filtered, and the filtrate was diluted with sufficient water to raise the filtrate volume to 100 ml. The relative amounts of phosphoric acid and acetic acid, and extraction efficiencies are shown in Table 4.

TABLE 4

CCA recovery rate with different concentration of phosphoric acid mixed with acetic acid at 160° C. for 30 min.

| Phosphoric Acid (wt %) | Acetic Acid (wt %) | As (% removed) | Cr (% removed) | Cu (% removed) |
|---|---|---|---|---|
| 3.5 | 2.0 | 99.52 | 99.30 | 99.02 |
| 2.75 | 2.0 | 99.48 | 99.21 | 99.01 |
| 2.0 | 2.0 | 98.89 | 74.32 | 98.23 |
| 1.25 | 2.0 | 96.77 | 51.77 | 97.99 |
| 0.5 | 2.0 | 95.50 | 25.79 | 96.87 |
| 3.5 | 1.5 | 99.52 | 99.21 | 98.97 |
| 2.75 | 1.5 | 99.24 | 97.98 | 98.65 |
| 2.0 | 1.5 | 98.66 | 73.33 | 97.98 |
| 1.25 | 1.5 | 97.79 | 49.36 | 97.56 |
| 0.5 | 1.5 | 95.01 | 24.57 | 96.22 |
| 3.5 | 1.0 | 99.52 | 98.10 | 98.60 |
| 2.75 | 1.0 | 99.06 | 96.37 | 98.56 |
| 2.0 | 1.0 | 99.01 | 72.18 | 97.46 |
| 1.25 | 1.0 | 96.66 | 50.03 | 97.38 |
| 0.5 | 1.0 | 94.05 | 23.52 | 95.38 |
| 3.5 | 0.5 | 99.61 | 95.35 | 98.01 |
| 2.75 | 0.5 | 99.01 | 96.23 | 98.07 |
| 2.0 | 0.5 | 98.54 | 70.37 | 97.36 |
| 1.25 | 0.5 | 96.03 | 48.95 | 96.85 |
| 0.5 | 0.5 | 93.57 | 23.06 | 95.12 |

Table 4 provides the extraction efficiencies for various concentrations of phosphoric and acetic acids. Regardless of the concentration of acetic acid, it appears that phosphoric acid percentage must be at least 2.75% to obtain in excess of 96% extraction of all metals. Increasing the phosphoric acid concentration from 2.75% to 3.5% had little effect on removal efficiency. Over 99% of all three metals can be removed with numerous combinations of phosphoric and acetic acid.

As can be seen from these Examples, single acids, for example, acetic, oxalic, or phosphoric acids, when used separately, did not result in complete or near complete removal of chromium, copper, and arsenic. When acetic and oxalic acid were combined and heated with microwaves, incomplete extraction still was also noted. The combination of phosphoric acid and acetic acid, when activated by microwave radiation, showed unexpected, essentially complete removal of As, Cr, and Cu.

The complete disclosures of all references cited in this specification are hereby incorporated by reference. In the event of an otherwise irreconcilable conflict, however, the present specification shall control.

We claim:

1. A process for extracting chromium, copper, and arsenic from wood treated with chromated copper arsenate wherein said process comprises the steps of:

a) mixing two or more acids with the treated wood;

b) heating the mixture of acids and treated wood with microwave radiation;

c) dissolving chromium, copper, and arsenic in the acid solution; and d) separating the acid solution containing chromium, copper, and arsenic from the wood.

2. A process as in claim 1 where the acids comprising the mixture of two or more acids are selected from the group consisting of sulfuric acid, phosphoric acid, hydrochloric acid, phosphorous acid, sulfurous acid, acetic acid, oxalic acid, and formic acid.

3. A process as in claim 1 where at least one of the acids has an acid dissociation constant of at least 1.0.

4. A process as in claim 1 where at least one of the acids is a mineral acid.

5. A process as in claim 4 where the mineral acid is phosphoric acid.

6. A process as in claim 1 where the microwave radiation causes the acid and wood mixture to be at a temperature between 75° C. and 200° C.

7. A process as in claim 1 where the microwave radiation causes the acid and wood mixture to be at a temperature of between 90° C. and 175° C.

8. A process as in claim 1 where the microwave radiation causes the acid and wood mixture to be at a temperature of between 120° C. and 160° C.

9. A process as in claim 1 where the ratio of acid to wood is between 1:1 and 40:1.

10. A process as in claim 1 where the ratio of acid to wood is between 5:1 to 30:1.

11. A process as claimed in claim 1, where the mixture of acids comprises phosphoric acid and oxalic acid.

12. A process as claimed in claim 11 where the concentration of the phosphoric acid is between 0.5% by weight and 3.5% by weight.

13. A process as claimed in claim 11 where the concentration of the oxalic acid is between 0.5% by weight and 3.5% by weight.

14. A process as claimed in claim 11 where the concentrations of both oxalic acid and phosphoric acid are between 0.5% by weight and 3.5% by weight, and wherein the concentrations of oxalic acid and phosphoric acid may be different.

15. A process as claimed in claim 1, where the mixture of acids comprises phosphoric acid and acetic acid.

16. A process as claimed in claim 15 where the concentration of the phosphoric acid is between 0.5% by weight and 3.5% by weight.

17. A process as claimed in claim 15 where the concentration of the acetic acid is between 0.5% by weight and 3.5% by weight.

18. A process as claimed in claim 15 where the concentrations of both acetic acid and phosphoric acid are between 0.5% by weight and 3.5% by weight, and wherein the concentrations of acetic acid and phosphoric acid may be different.

19. A process as claimed in claim 1 where chromium, copper, and arsenic are precipitated from the acid solution remaining after the acid solution is separated from the wood.

20. A process as in claim 1 comprising treating wood particles that are less than 1 centimeter cubed.

21. A process as in claim 1 comprising treating wood particles that pass through a 20-mesh sieve.

22. A process for extracting chromium, copper, and arsenic from wood treated with chromated copper arsenate wherein said process comprises the steps of:

a) mixing two or more acids with the treated wood;
b) heating the mixture of acids and treated wood with microwave radiation;
c) dissolving chromium, copper, and arsenic in the acid solution;
d) separating the acid solution containing chromium, copper, and arsenic from the wood;
e) precipitating chromium, copper, and arsenic from the acid solution for reuse: and
f) liquefying the wood separated from chromium, copper and arsenic using a liquefaction reagent and microwave radiation.

23. A process as in claim 22 where the acids comprising the mixture of two or more acids are selected from the group consisting of sulfuric acid, phosphoric acid, hydrochloric acid, phosphorous acid, sulfurous acid, acetic acid, oxalic acid, and formic acid.

24. A process as in claim 22 where at least one of the acids has an acid dissociation constant of at least 1.0.

25. A process as in claim 22 where at least one of the acids is a mineral acid.

26. A process as in claim 22 where the mineral acid is phosphoric acid.

27. A process as in claim 22 where the microwave radiation causes the acid and wood mixture to be at a temperature between 75° C. and 200° C.

28. A process as in claim 22 where the microwave radiation causes the acid and wood mixture to be at a temperature of between 90° C. and 175° C.

29. A process as in claim 22 where the microwave radiation causes the acid and wood mixture to be at a temperature of between 120° C. and 160° C.

30. A process as claimed in claim 22, where the mixture of acids comprises phosphoric acid and oxalic acid.

31. A process as in claim 22 where the ratio of acid to wood is between 1:1 and 40:1.

32. A process as in claim 22 where the ratio of acid to wood is between 5:1 to 30:1.

33. A process as claimed in claim 30 where the concentration of the phosphoric acid is between 0.5% by weight and 3.5% by weight.

34. A process as claimed in claim 30 where the concentration of the oxalic acid is between 0.5% by weight and 3.5% by weight.

35. A process as claimed in claim 30 where the concentrations of both oxalic acid and phosphoric acid are between 0.5% by weight and 3.5% by weight, and wherein the concentrations of oxalic acid and phosphoric acid may be different.

36. A process as claimed in claim 22, where the mixture of acids comprises phosphoric acid and acetic acid.

37. A process as claimed in claim 36 where the concentration of the phosphoric acid is between 0.5% by weight and 3.5% by weight.

38. A process as claimed in claim 36 where the concentration of the acetic acid is between 0.5% by weight and 3.5% by weight.

39. A process as claimed in claim 36 where the concentrations of both acetic acid and phosphoric acid are between 0.5% by weight and 3.5% by weight, and wherein the concentrations of acetic acid and phosphoric acid may be different.

40. A process as claimed in claim 22 where chromium, copper, and arsenic are precipitated from the acid solution remaining after the acid solution is separated from the wood by adding concentrated inorganic acid.

41. A process as in claim 40 where the inorganic acid is selected from the group consisting of sulfuric acid, nitric acid, and phosphoric acid.

42. A process as in claim 22 comprising treating wood particles are less than 1 centimeter cubed.

43. A process as in claim 22 comprising treating wood particles pass through a 20-mesh sieve.

44. A process as in claim 22 where the liquefaction reagent is selected from the group consisting of phenol, polyethylene glycol, glycerin, ethylene carbonate, and mineral acids.

45. A process as in claim 44 where the mineral acid is selected from the group consisting of sulfuric acid, nitric acid, and phosphoric acid.

* * * * *